US008480777B2

(12) United States Patent
Sakaguchi et al.

(10) Patent No.: US 8,480,777 B2
(45) Date of Patent: Jul. 9, 2013

(54) OIL SEPARATION DEVICE OF ENGINE

(75) Inventors: Takahiro Sakaguchi, Hiroshima (JP); Shigemi Okada, Hiroshima (JP); Tokio Kagawa, Hiroshima (JP); Jun Yamane, Hiroshima (JP); Naoki Suizu, Hiroshima (JP); Suguru Fukui, Hiroshima (JP); Toshinobu Mori, Hiroshima (JP); Yusuke Nakata, Hiroshima (JP); Takashi Fukui, Hiroshima (JP)

(73) Assignee: Mazda Motor Corporation (JP)

( * ) Notice: Subject to any disclaimer, the term of this patent is extended or adjusted under 35 U.S.C. 154(b) by 217 days.

(21) Appl. No.: 13/162,105

(22) Filed: Jun. 16, 2011

(65) Prior Publication Data

US 2011/0314779 A1 Dec. 29, 2011

(30) Foreign Application Priority Data

Jun. 24, 2010 (JP) ..... 2010-143435

(51) Int. Cl.
*B01D 45/08* (2006.01)

(52) U.S. Cl.
USPC ..... 55/464; 55/462; 55/463; 55/413; 55/414; 55/440; 55/385.3; 55/423; 55/428; 55/DIG. 19; 123/198 E; 123/41.86; 95/272

(58) Field of Classification Search
USPC ..... 55/462–464, 413, 414, 440, 385.3, 55/DIG. 19, 423, 428; 123/198 E, 41.86; 95/272
See application file for complete search history.

(56) References Cited

FOREIGN PATENT DOCUMENTS

JP 2008-038620 A 2/2008

*Primary Examiner* — In Suk Bullock
*Assistant Examiner* — Dung H Bui
(74) *Attorney, Agent, or Firm* — Studebaker & Brackett PC

(57) ABSTRACT

An extension piece portion is provided at a lower end portion of a screen plate so as to extend from the lower end portion, beyond a gas-passing through hole, to an oil pocket portion. An oil guide portion is provided at respective gas-hitting-side face portions of the screen plate and the extension piece portion so as to guide oil trapped at the above-described face portions into the oil pocket portion. Accordingly, it can be prevented that part of the oil in the middle of dropping down into the oil pocket portion from the screen plate is carried away by the gas flow passing through the gas-passing through hole, so that the efficiency of oil trap can be improved.

5 Claims, 5 Drawing Sheets

OIL SEPARATION DEVICE OF ENGINE

BACKGROUND OF THE INVENTION

The present invention relates to an oil separation device of an engine.

Conventionally, an oil separation device to separate oil mists contained in blow-by gas which generates in a crank chamber of an engine is known (see Japanese Patent Laid-Open Publication No. 2008-038620).

In this oil separation device, an oil separation chamber is provided in a space inside a cylinder head cover of the engine. In the oil separation chamber, a partition plate to partition this chamber into an upstream chamber and a downstream chamber is provided. This separation chamber has a connection hole to restrict flow of the gas passing through this hole and thereby increase the flowing speed of the gas. Further, a screen plate is provided downstream of the partition plate, facing the partition plate. The blow-by gas passing through the connection hole hits against the screen plate, so that the oil mists contained in the blow-by gas can be trapped at the screed plate.

The blow-by gas having hit against the screen plate (the gas flow after the oil mists are removed) flows down through a gas-passing through hole formed below the screen plate. Meanwhile, liquid oil which is formed after hitting of the oil mists against the screen plate naturally flows down along a gas-hitting face of the screen plate, drops into a concave oil-discharge portion which is formed below the gas-passing through hole, and is finally discharged to the outside of an oil circulation system. Thus, the oil mists contained in the blow-by gas can be separated.

According to the conventional oil separation device of an engine, however, since the oil trapped at the screen plate drops into the oil-discharge portion (oil pocket portion) through the gas-passing through hole which constitutes a gas-flow passage, part of the oil which is in the middle of dropping down is carried away by the gas flow passing through the gas-passing through hole, so that there is a problem in that the efficiency of oil trap may deteriorate.

SUMMARY OF THE INVENTION

The present invention has been devised in view of the above-described problem, and an object of the present invention is to provide an oil separation device of an engine which can prevent part of the oil in the middle of dropping down into the oil pocket portion from the screen plate from being carried away by the gas flow passing through the gas-passing through hole, thereby improving the efficiency of oil trap.

According to the present invention, there is provided an oil separation device of an engine, comprising an oil separation chamber in which blow-by gas generating in the engine flows horizontally, a partition plate provided in the oil separation chamber to partition the oil separation chamber into an upstream chamber and a downstream chamber, a connection hole formed at the partition plate, a screen plate provided in the oil separation chamber downstream of the partition plate and facing the partition plate, the blow-by gas passing through the connection hole hitting against the screen plate, a gas-passing through hole formed below the screen plate and allowing the blow-by gas having hit against the screen plate to flow therethrough, an oil pocket portion provided below the gas-passing through hole and accepting oil flowing down from the screen plate, an extension piece portion provided at a lower end portion of the screen plate and extending from the lower end portion, beyond the gas-passing through hole, to the oil pocket portion, and an oil guide portion provided at a face portion of the screen plate on the side of gas hitting and a face portion of the extension piece portion on the side of gas hitting, and guiding the oil trapped at the face portions into the oil pocket portion.

According to the present invention, the blow-by gas generating in the engine flows into the downstream chamber from the upstream chamber passing through the connection hole provided at the screen plate. The gas flow passing through the connection hole increases in speed due to its throttle effect and hits against the screen plate, so that oil mists contained in the gas flow are liquidized, then the liquidized oil comes to be trapped at the face portion of the screen plate on the side of gas hitting. The trapped oil naturally flows down and is collected by the oil guide portion, and then discharged into the oil pocket portion along the extension piece portion.

As described above, the present invention is configured so that the oil trapped at the face portion of the screen plate on the side of gas hitting does not drop into the oil pocket portion, but flows along the extension portion and then into the oil pocket portion. Thereby, it can be prevented that part of the oil which is in the middle of dropping down from the screen plate is carried away by the gas flow passing through the gas-passing through hole. Accordingly, the efficiency of oil trap can be improved properly.

According to an embodiment of the present invention, the oil guide portion comprises a concave groove which is formed at the face portions of the screen plate and the extension piece portion. Thereby, the oil guide portion can be efficiently formed in a narrow space with high layout flexibility.

According to another embodiment of the present invention, the oil guide portion comprises a bank portion which is formed in a convex shape at the face portions of the screen plate and the extension piece portion. Thereby, even if the amount of oil separated is large due to its high oil-mist ratio, the oil can be securely guided to the oil pocket portion by the bank portion without overflowing.

According to another embodiment of the present invention, the above-described oil guide portion is formed at a lower edge of the screen plate over a whole length of the lower edge. Thereby, the oil flowing down along the face portion of the screen plate on the side of gas hitting can be properly collected and guided to the oil pocket portion by the oil guide portion.

Other features, aspects, and advantages of the present invention will become apparent from the following description which refers to the accompanying drawings.

DETAILED DESCRIPTION OF THE INVENTION

Figure 1:
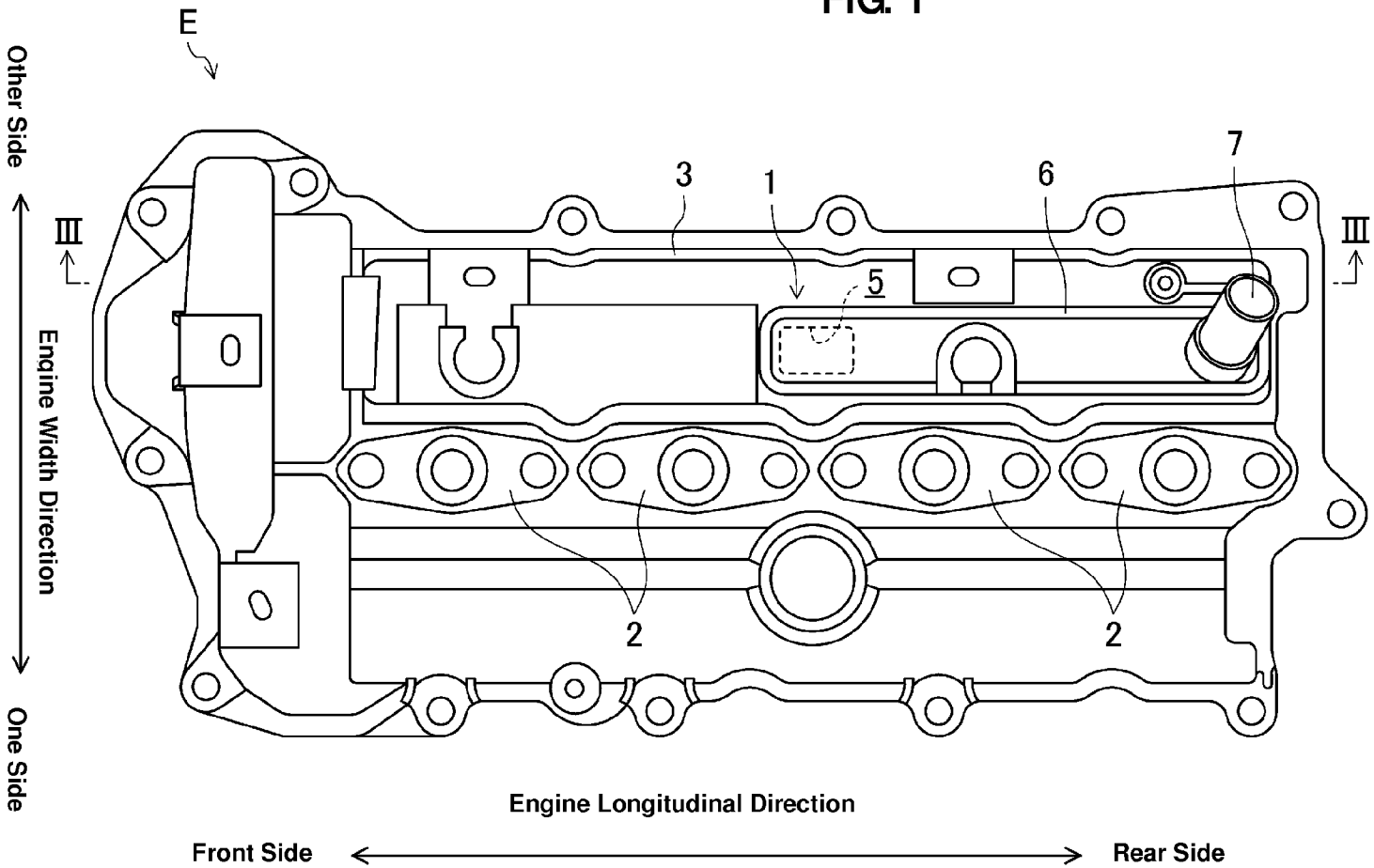
FIG. 1 is a plan view of an engine equipped with an oil separation device according to an embodiment of the present invention, when viewed from above.

Hereafter, preferred embodiments of the present invention will be descried referring to the drawings.

Figure 2:
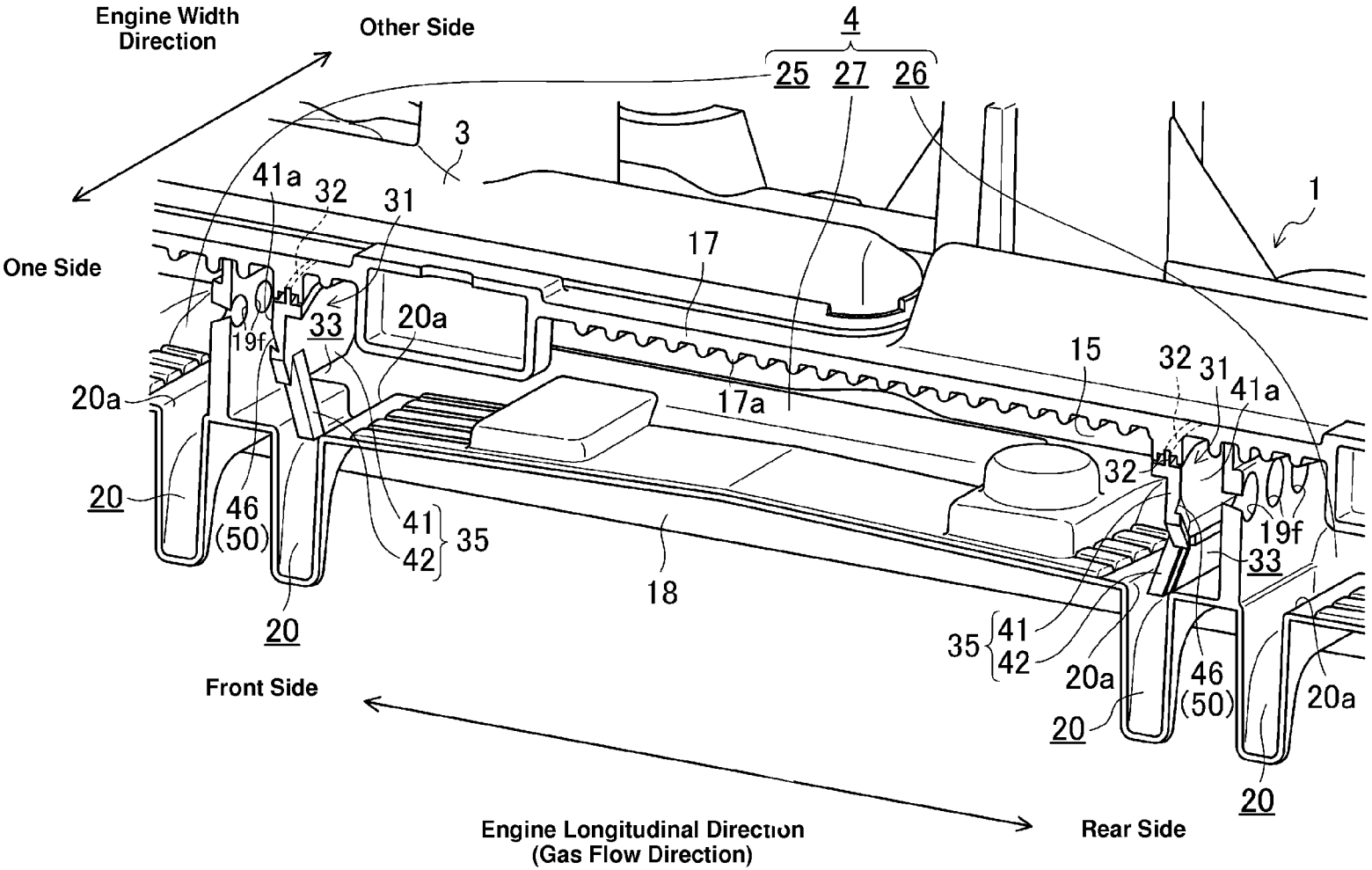
FIG. 2 is a perspective view showing the inside of an oil separation chamber, when viewed from one side in an engine width direction.
Figure 3:
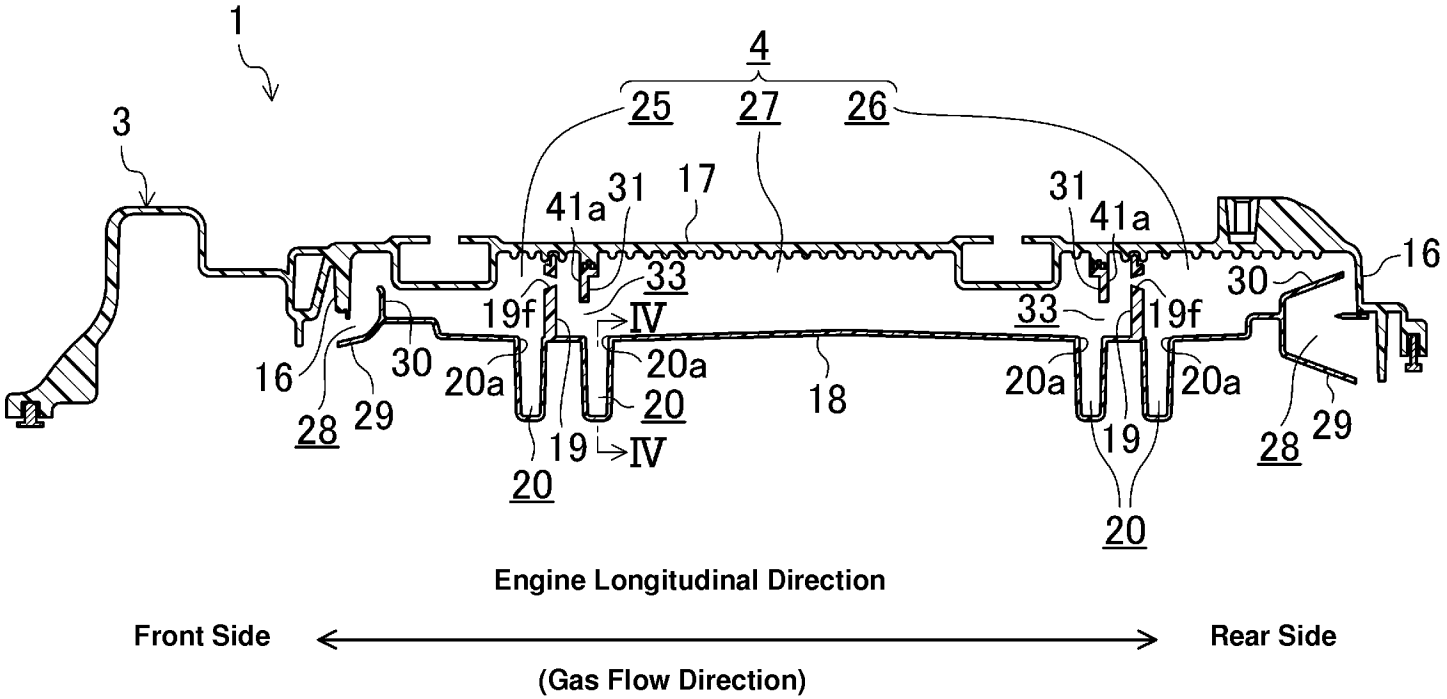
FIG. 3 is a sectional view taken along line III-III of FIG. 1.

FIGS. 1-3 show an oil separation device 1 of an engine according to an embodiment of the present invention, which separates oil mists contained in blow-by gas which leaks from gaps between a cylinder and pistons of an engine E into a crank case. The oil separated by the oil separation device 1 is returned to an engine's oil circulation system, and the remaining gas without oil is supplied to an engine's intake system again.

FIG. 1 is a plan view of the engine E equipped with the oil separation device 1, when viewed from above. The left side of FIG. 1 corresponds to a front side of the engine, and the right side of FIG. 1 corresponds to a rear side of the engine. Further, the vertical direction of this figure corresponds to an engine width direction, the lower side of this figure is defined as one side in the engine width direction, and the upper side of this figure is defined as the other side in the engine width direction.

The engine E of the present embodiment, a four-cylinder diesel engine, has a row of fuel injection devices 2 at the center, in the engine width direction, of a cylinder head cover 3 of the engine E as shown in FIG. 1.

The oil separation device 1 is arranged at the cylinder head cover 3 at a location which is on the other side in the engine width direction (on the side of engine exhaustion), and comprises an oil separation chamber 4 which is partitioned inside the cylinder head cover 3. At an upper face of the cylinder head cover 3 is provided a supplementary cover 6 which forms a gas passage to circulate the gas flow passing through the oil separation chamber 4 to the intake system. The supplementary cover 6 extends from a central portion in an engine longitudinal direction to the rear side of the engine, and an outlet port 7 is provided at an engine-rear-side end portion of the supplementary cover 6.

The oil separation chamber 4 is enclosed by a pair of right-and-left side plate portions 15 which face each other in the engine width direction (only one illustrated in FIG. 2), a pair of front-and-rear side plate portions 16 which face each other in the engine longitudinal direction (FIG. 3), and a top plate portion 17 and a bottom plate portion 18 which face each other in the vertical direction. The plate portions 15, 16 and 17 constitute part of the cylinder head cover 3. The cylinder head cover 3 and the bottom plate portion 18 are made of resin-made members. The bottom plate portion 18 has partition plates 19 and oil pocket portions 20, which will be described below.

Plural projection beads 17*a* which extend in a direction crossing to a main stream of the gas flow and in parallel to each other are formed at the inner face (lower face) of the top plate portion 17.

The oil separation chamber 4 is partitioned into three spaces located in the engine longitudinal direction by the two partition plates 19 which extend upward from the upper face of the bottom plate portion 18. Two spaces located on the both side of the central space constitute upstream chambers 25, 26 of the gas flow, and the central space constitutes a downstream chamber 27 of the gas flow. Herein, each partition plate 19 is integrally formed at the bottom plate portion 18. The bottom plate portion 18 is fixed to the cylinder head cover 3 by melting-attaching of its almost-whole outer edge portion. The partition plates 19 are fixed to the cylinder head cover 3 by melting-attaching of their upper edge portions.

An introduction flow passage 28 to introduce the blow-by gas is formed in each of the upstream chambers 25, 26. These introduction flow passages 28 are formed in labyrinth shape with guide plates 29 and back-flow prevention plates 30 which are respectively formed at both end portions of the bottom plate portion 18 in the engine longitudinal direction. Each introduction flow passage 28 connects to a valve-drive chamber on the cylinder head, and eventually connects to a crank chamber (not illustrated) of the engine E where the blow-by gas generates.

Plural connection holes 19*f* (five holes in the present embodiment) are formed at an upper end portion of each of the two partition plates 19 in the engine width direction at regular intervals. Each connection hole 19*f* is formed in a taper-hole shape so that the diameter of its downstream portion is smaller than that of its upstream portion. Thereby, the gas flow passing through the connection hole 19*f* is increased in speed by using the nozzle function. Further, when the engine stops (no gas flow occurs), the oil trapped at the taper face naturally flows down into the upstream chamber along the slant, and then is discharged into the oil pocket portion 20 which will be described later.

Inside the downstream chamber 27 are arranged two screen plates 31 which respectively extend downward from the top plate portion 17 and face the partition plates 19. Each screen plate 31 is located downstream of the partition plate 19 in the gas flow direction, and the gas flow accelerated after passing through the connection hole 19*f* of the partition plate 19 hits against the screen plate 31, so that the oil mists contained in the gas flow are trapped at the screen plate 31 and liquidized. Each screen plate 31 is fixed to the inner face of the top plate portion 17 at its upper edge portion by melt-attaching. Herein, the screen plate 31 may be made from resin integrally with the top plate portion 17.

A gas-passing through hole 33 which allows the blow-by gas having hit against the screen plate 31 to flow therethrough is formed between a lower edge of the screen plate 31 and the bottom plate portion 18. It is preferable that the flow-passage area of the gas-passing through hole 33 be set within a range of about ⅓-½ of the flow-passage area of the upstream portion of the screen plate 31. Thereby, it can be prevented that the flowing speed of the gas flow passing through the gas-passing through hole 33 becomes too high.

The oil pocket portions 20 to accept the oil collected at the screen plates 31 are formed at respective positions of the bottom plate portion 18 which are located below the gas-passing through holes 33. Likewise, the other oil pocket portions 20 to accept the oil trapped at the partition plates 19 and then naturally flowing down are formed at respective positions of the bottom plate portion 18 which are located near upstream of the partition plates 19.

Figure 4:
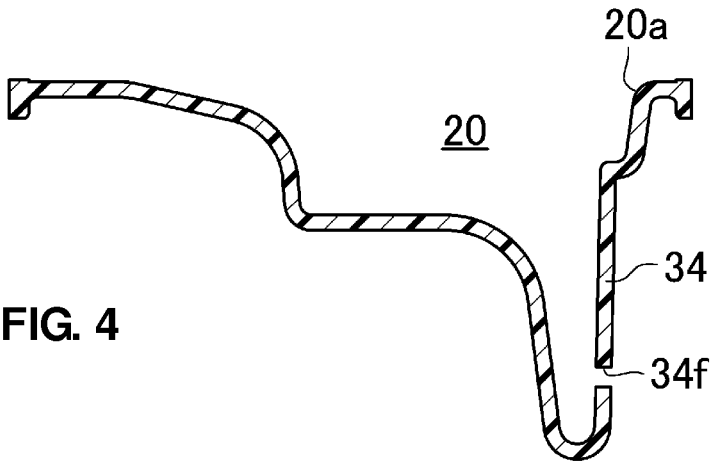
FIG. 4 is a sectional view taken along line IV-IV of FIG. 3.

Each oil pocket portion 20 is formed in a concave shape so that part of the bottom plate portion 18 projects downward. An upper opening 20*a* of the oil pocket portion 20 is of a substantially rectangular shape so that it extends in the engine width direction over an entire width of the bottom plate portion 18 of the oil separation chamber 4. The oil pocket portion 20 is formed in a step shape when viewed in the engine longitudinal direction (see FIG. 4), and a substantially U-shaped oil reservoir portion 34 is formed at one end portion of the oil pocket portion 20 in the engine width direction. An oil outlet port 34*f* is formed at the oil reservoir portion 34 at a location which is slightly above its lower end.

Figure 5:
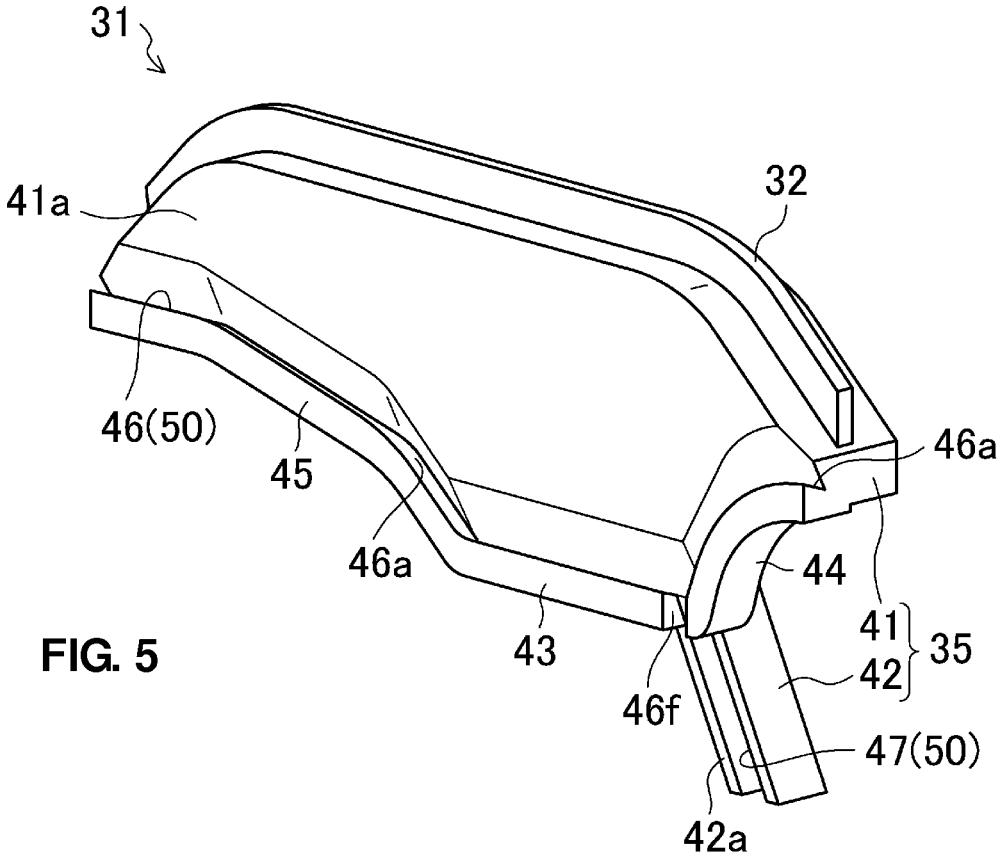
FIG. 5 is a perspective view showing a screen plate, when viewed obliquely from above and the side of gas hitting.
Figure 6:
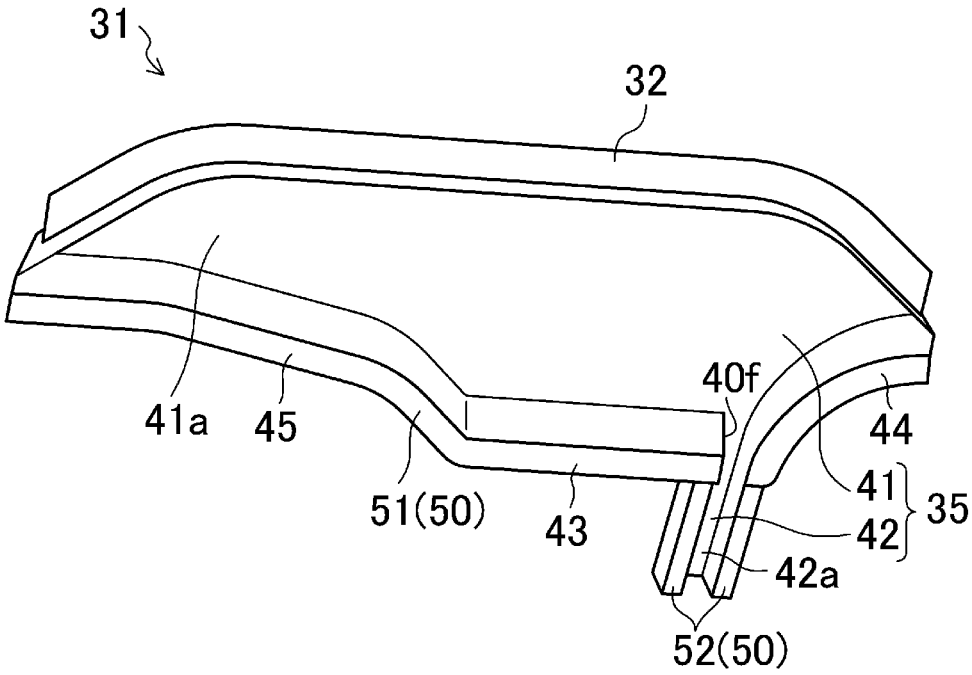
FIG. 6 is a perspective view showing a modification of the screen plate, when viewed obliquely from above and the side of gas hitting.

The screen plate 31, as shown in FIGS. 5 and 6, comprises a body plate portion 41 which has a gas-hitting face 41*a* perpendicular to the gas-flow direction (the direction matching the engine longitudinal direction) and an extension piece portion 42 which is provided at a lower end portion of the body plate portion 41 and extends to the oil pocket portion 20.

An upper edge of the body plate portion 41 is formed so that its both end portions slant downward and outward in its width direction. A melting portion 32 is formed at the upper edge of the body plate portion 41 over its entire edge.

A lower edge of the body plate portion 41 is formed so that its both end portions slant upward and outward in its width direction. That is, the lower edge of the body plate portion 41 is formed so that its middle portion projects downward beyond its both end portions. More specifically, the lower edge of the body plate portion 41 comprises a horizontal side portion 43 which extends substantially horizontally in the engine width direction, a one-side slant side portion 44 which is connected to a one-side end portion of the horizontal side portion 43, and an other-side slant side portion 45 which is connected to an other-side end portion of the horizontal side portion 43. A concave oil guide groove 46 is provided at the gas-hitting face 41*a* of the body plate portion 41 over its entire lower edge.

The oil guide groove 46 is formed so that its section has a V shape and opens upstream in the gas flow direction. An oil receiving face (a lower slant face) 46*a* of the oil guide groove 46 slants upward, that is, upstream of the gas flow. Thereby, the holding function of oil by the oil guide groove 46 can be improved. Further, the oil guide groove 46 formed along the horizontal side portion 43 slants downward (closer to the extension piece portion 42) from the other side to the one side in the engine width direction so as to guide the oil collected in the groove 46 to the extension piece portion 42 which will be described later (the above-described slant is not illustrated in FIG. 5).

An upper end portion of the extension piece portion 42 is connected to a connection portion between the horizontal side portion 43 and the one-side slant portion 44, and the extension piece portion 42 slants toward a back face of the screen plate 31 from its upper end side to its lower end side. That is, the extension portion 42 slants downward and downstream of the gas flow. A lower end of the extension piece portion 42 is positioned inside the oil pocket portion 20 (below an upper end of the oil pocket portion 20) in the present embodiment.

At a face 42*a* of the extension piece portion 42 on the gas-hitting side, likewise, is formed a V-shaped oil guide groove 47 which extends along the extension piece portion 42. The oil guide groove 47 is continuous from the oil guide groove 46 which is formed along the lower edge of the body plate portion 41 via a connection groove 46*f*. These oil guide grooves 46, 47 which are formed at the screen plate 31 and the extension piece portion 42 constitute an oil guide portion 50 of the present invention.

In the separation device 1 as constituted above, the blow-by gas generating during the running of the engine E flows into the upstream chambers 25, 26 through the respective introduction flow passages 28. The gas flow flowing into the upstream chambers 25, 26 hits against the partition plates 19, so that part of the oil mists contained in the gas flow is liquidized and trapped at the partition plates 19. This oil naturally flows down and is discharged into the oil pocket portions 20.

Further, the gas flow introduced into the upstream chambers 25, 26 increases its speed by passing through the plural connection holes 19*f* formed at the separation plates 19, and flows into the downstream chamber 27. Herein, the high-speed gas flow having flowed into the downstream chamber 27 hits against the screen plates 31, so that the oil mists contained in the gas flow is trapped at the gas-hitting faces 41*a* of the screen plates 31 and liquidized. Thus, most part of the oil mists contained in the gas flow is liquidized and trapped at the screen plates 31.

The gas flow having hit against the screen plates 31 (after the oil mists are removed) passes through the gas-passing through holes 33 which are provided below the screen plates 31 and flows downstream further, and then passes through a gas outlet port 5 which is formed at the top plate portion 17 (see FIG. 1) and is guided to the supplementary cover 6. Further, since the plural beads 17*a* are formed at the inner face of the top plate portion 17 perpendicularly to the gas flow direction as described above, the oil mists contained in the gas can be trapped with the beads 17*a*.

Meanwhile, in the conventional oil separation device, when the oil trapped at the gas-hitting face of the screen plate drops into the oil pocket portion, it passes through the gas-passing through hole and then drops down into the oil pocket portion. Accordingly, part of the oil which is in the middle of dropping down is carried away by the gas flow passing through the gas-passing through hole, so that there is a problem in that the efficiency of oil trap may deteriorate.

According to the present embodiment, however, since there are provided the extension piece portion 42 provided at the lower end portion of the screen plate 31 (body plate portion 41) and extending from the lower end portion, beyond the gas-passing through hole 33, to the oil pocket portion 20, and the oil guide grooves 46, 47 formed along the lower edge of the screen plate 31 and the extension piece portion 42, the oil trapped at the gas-hitting face 41*a* can be guided so as to flow into the oil pocket portion 20 by way of the oil guide grooves 46, 47, without receiving any improper influence of the gas flow passing through the gas-passing through hole 33. Accordingly, the oil trapped at the gas-hitting face 41*a* does not drop into the pocket portion 20 over the gas-passing through hole 33. Thus, it can be prevented that part of the oil which is in the middle of dropping down is carried away by the gas flow so that the efficiency of oil trap deteriorates.

Further, since the oil guide groove 46 provided at the screen plate 31 is formed along the lower edge of the screen plate 31 (body plate portion) over a whole length of the lower edge in the present embodiment, the oil flowing down along the gas-hitting face 41*a* of the screen plate 31 can be properly collected and guided into the oil pocket portion 20. Accordingly, the oil trap efficiency can be improved properly.

Moreover, since the oil guide portion 50 of the present embodiment is comprised of the concave grooves 46, 47, it can be efficiently formed in a narrow space with high layout flexibility.

Also, the extension piece portion 42 of the present embodiment is formed to slant downward and downstream of the gas flow. Thereby, the oil collected in the oil guide groove 47 of the extension piece portion 42 can be made positively flow down along the gas flow. Accordingly, the discharge of the oil by the oil guide groove 47 can be improved. Consequently, it can be prevented that the oil stays in the oil guide grooves 46, 47 and thereby the oil collection function deteriorates.

FIG. 6 shows a modification of the above-described embodiment, in which the oil guide portion 50 has a different structure. Herein, the substantially same structure elements as those shown in FIG. 5 are denoted by the same character references, so their specific descriptions are omitted.

That is, according to this modification, the oil guide portion 50 comprises a projecting wall portion (bank portion) 51 which is formed in a convex shape along the lower edge of the gas-hitting face 41*a* of the screen plate 31, and another projecting wall portion (bank portion) 52 which is formed in the convex shape at the gas-hitting-side face 42*a* of the extension piece portion 42 along the extension piece portion 42. The projecting wall portion 51 formed at the gas-hitting face 41*a* slants upward and toward upstream of the gad flow so as to improve the collection performance of the oil flowing down by the projecting wall portion 51 (the above-described slant is not illustrated in FIG. 6).

According to this structure, the oil flowing down along the gas-hitting face 41*a* can be received by the projecting wall portion 51 and then guided into the pocket portion 20 via the extension piece portion 42. Accordingly, the similar operation and effect to those of the above-described embodiment can be obtained.

Further, this modification may be effective to restrain overflow of the oil in case the oil-mist ratio is rather high and the amount of oil separation is large.

The present invention should not be limited to the above-described embodiment and modification, and any other modifications and improvements may be applied within the scope of a spirit of the present invention.

For example, while the gas flow in the oil separation chamber 4 flows in the engine longitudinal direction in the above-described embodiment, it may flow in the engine width direction as long as it flows horizontally.

Further, while the concave-shaped grooves (oil guide grooves 46, 47) of the oil guide portion 50 are formed so that their sections have the V shape in the above-described embodiment, they may be formed so that their sections have an arch shape.

Moreover, while the oil guide portion 50 of the above-described embodiment is formed in the concave-groove shape or the projecting wall portions 51, 52 constitute the oil guide portion 50 in the above-described modification, the oil guide portion 50 formed at the lower edge of the body plate portion 41 of the screen plate 31 may be comprised of the projecting wall portion 51, whereas the oil guide portion 50 formed at the extension piece portion 42 may be comprised of the concave-shaped groove.

Also, while the projecting wall portions 51, 52 of the oil guide portion 50 are formed integrally with the body plate portion 41 and the extension piece portion 42 in the above-described modification, they may be formed separately and joined to the body plate portion 41. Thereby, the oil guide portion 50 is formed merely by attaching the projecting wall portions 51, 52 to the existing screen plate 31, so that the diversion of existing parts can be increased.

What is claimed is:

1. An oil separation device of an engine, comprising:

an oil separation chamber in which blow-by gas generating in the engine flows horizontally;

a partition plate provided in the oil separation chamber to partition the oil separation chamber into an upstream chamber and a downstream chamber;

a connection hole formed at the partition plate;

a screen plate provided in the oil separation chamber downstream of the partition plate and facing the partition plate, the blow-by gas passing through the connection hole hitting against the screen plate;

a gas-passing through hole formed below the screen plate and allowing the blow-by gas having hit against the screen plate to flow therethrough;

an oil pocket portion provided below the gas-passing through hole and accepting oil flowing down from the screen plate;

an extension piece portion provided at a lower end portion of the screen plate and extending from the lower end portion, beyond the gas-passing through hole, to the oil pocket portion; and an oil guide portion provided at a face portion of the screen plate on the side of gas hitting and a face portion of the extension piece portion on the side of gas hitting, and guiding the oil trapped at said face portions into the oil pocket portion.

2. The oil separation device of an engine of claim 1, wherein said oil guide portion comprises a concave groove which is formed at said face portions of the screen plate and the extension piece portion.

3. The oil separation device of an engine of claim 2, wherein said oil guide portion is formed at a lower edge of said screen plate over a whole length of the lower edge.

4. The oil separation device of an engine of claim 1, wherein said oil guide portion comprises a bank portion which is formed in a convex shape at said face portions of the screen plate and the extension piece portion.

5. The oil separation device of an engine of claim 4, wherein said oil guide portion is formed at a lower edge of said screen plate over a whole length of the lower edge.

* * * * *